US007063175B1

(12) United States Patent
Kerstetter

(10) Patent No.: US 7,063,175 B1
(45) Date of Patent: Jun. 20, 2006

(54) METHOD AND APPARATUS FOR RETAINING A DOWN-HOLE FLUID MOTOR AND BIT ASSEMBLY

(76) Inventor: Scott Kerstetter, 103 Guernsey La., Youngsville, LA (US) 70592

( * ) Notice: Subject to any disclaimer, the term of this patent is extended or adjusted under 35 U.S.C. 154(b) by 122 days.

(21) Appl. No.: 10/870,661

(22) Filed: Jun. 16, 2004

(51) Int. Cl.
*E21B 17/03* (2006.01)
*E21B 4/02* (2006.01)

(52) U.S. Cl. ..... 175/57; 175/107; 175/320

(58) Field of Classification Search ..... 175/107, 175/320, 321, 57
See application file for complete search history.

(56) References Cited

U.S. PATENT DOCUMENTS 2,167,019 A * 7/1939 Yost ..... 175/101
3,047,079 A * 7/1962 Wepsala, Jr. ..... 175/107
3,077,937 A * 2/1963 Tiraspolsky et al. ..... 175/107
3,159,222 A * 12/1964 Hammer et al. ..... 175/107
4,260,030 A * 4/1981 Fox ..... 175/107
5,165,492 A 11/1992 Beasley
6,540,020 B1 4/2003 Falgout, Sr.
2002/0166700 A1 * 11/2002 Gillis et al. ..... 175/57

* cited by examiner

*Primary Examiner*—Hoang Dang
(74) *Attorney, Agent, or Firm*—Robert N. Montgomery

(57) ABSTRACT

A retaining apparatus is provided for preventing the separation and loss of a down-hole drive motor and associated drill bit from the drill string due to gyroscopic precession of the motor housing resulting from counter torque produced by the drill bit. The retaining apparatus includes a collet, an expander with interchangeable nozzles and a fluid bypass flange.

10 Claims, 3 Drawing Sheets

METHOD AND APPARATUS FOR RETAINING A DOWN-HOLE FLUID MOTOR AND BIT ASSEMBLY

FIELD OF THE INVENTION

This invention relates generally to apparatuses for capturing and thereby preventing the disassembly of a down-hole mud motor as a result of counter rotation of the power section relative to a portion of the motor housing.

GENERAL BACKGROUND

Down-hole tools such as mud motors that are hydrostatically driven and therefore rotatable relative to the drill string are used to drive the drill bit. Rather than having a larger surface motor rotate the entire drill string, a down-hole mud motor rotates the drill bit. This arrangement is especially useful in horizontal bores.

Generally, such motors utilize some type of bearing so that the down-hole mud motor is allowed to rotate relative to the drill string. These down-hole motors are subjected to a very hostile environment such as exposure to high heat, vibration, and high velocity solids. Accordingly, it is not uncommon for the motor bearings to fail. Bearing failure causes the motor to stall. However, since the operators of the drilling operation are ordinarily unaware of such failure and thus continue driving the down-hole motor, the continued rotational force applied to the drill bit by the down-hole mud motor power section has a tendency to rotate the portion of the motor housing located below the power section. Rotation of these sections of the down-hole motor housing eventually results in at least one of the sections and the drill bit becoming separated from the remainder of the down-hole mud motor housing and possibly being lost in the well bore. If the motor housing and bit are lost in the well bore, generally it is time consuming and expensive to perform fishing operations in an attempt to retrieve the lost components. When these relatively expensive components cannot be retrieved, they generally continue to impede further drilling operations.

Various methods have been employed within the art to overcome the above stated problem. For example Falgout and Beasley, in U.S. Pat. Nos. 6,540,020 and 5,165,492 respectively, disclose a valve having means for biasing the valve against rotation of the housing in a manner that allows the flow of fluid to the motor to be cut off if the fluid motor housings and bit separate. It is suggested that this restriction in fluid flow will alert the operators on the surface that a problem exists and thus initiate a removal of the mud motor procedure for inspection. A sudden disruption of flow in the form of a blockage at high pressure in excess of 6000 psi certainly tends to get someone's attention when the surface pump is destroyed as a result. In addition, once the fluid to the down-hole motor is shut off, it becomes very difficult to withdraw the drill string. In such cases, extraordinary measures must be taken to free the bit manually and retrieve the drill string.

The present invention is directed to overcoming or minimizing one or more of the problems discussed above.

SUMMARY OF THE INVENTION

A retaining apparatus is provided for preventing the separation and loss of a down-hole drive motor and associated drill bit from the drill string due to gyroscopic precession of the motor housing resulting from counter torque produced by the drill bit. The retaining apparatus includes; a collet, an expander pin with interchangeable nozzles, and a fluid bypass flange.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
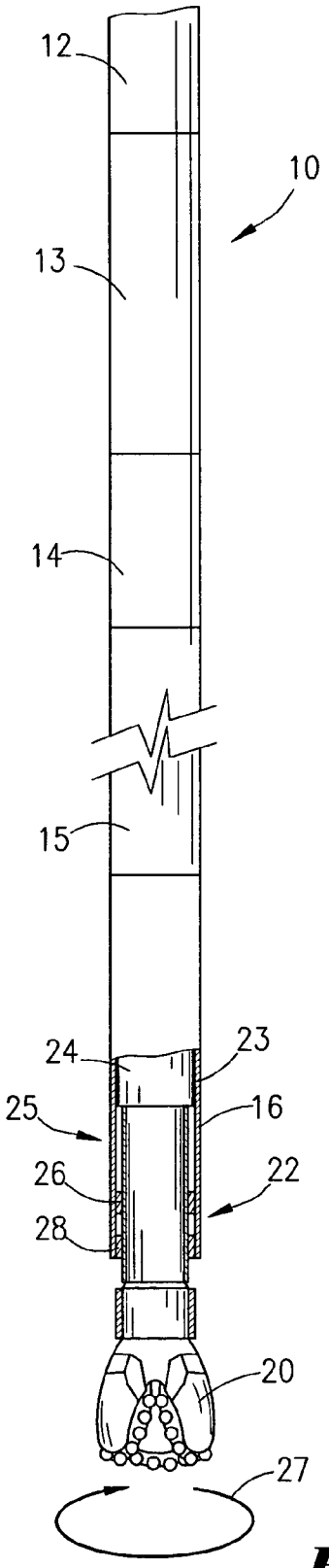
FIG. 1 is a partial view of a down-hole drill string.

As may be seen in the stylized view of a drill string 10, shown in FIG. 1, the drill string 10 is composed of a series of tubular members 12, 13, 14, 15, 16 threaded together to form a hollow-core cylinder. Preferably, the tubular members 12, 13, 14, 15, 16 are joined together by threaded connections that employ right hand threads. A drill bit 20 is depicted rotatably connected at the bottom of the drill string 10 via a down-hole motor assembly 25 located within the lowermost tubular members 15, 16. The down-hole motor 25 includes a housing 23, a power section 24, and a bearing section 22.

To effect rotation of the drill bit 20 relative to the drill string 10, the conventional down-hole motor 25 located within the core of the drill string 10 is operated by pumping drilling fluid through the core of the drill string 10 and the motor 25, imparting a rotational movement to the drill bit 20. Generally the drill bit 20 is rotated in a clockwise direction, as viewed from a vantage point above the drill string 10, as indicated by an arrow 27 adjacent the bit 20.

Since the drill bit 20 is rotatable relative to the drill string 10, the bearing section 22 is provided to reduce frictional wear between the two members and generally includes at least two sets of bearings 26, 28 spaced longitudinally apart to reduce rotational wobble of the drill bit 20 relative to the drill string 10 as it rotates.

In some cases the bearings 26, 28 cease to operate properly so that the drill bit 20 does not freely rotate relative to the drill string 10, in which case the clockwise rotational force applied to the drill bit 20 is also applied to the drill string 10 through the bearings 26, 28 and, in particular, to the lower tubular member 16 of the housing 23. Since the lower tubular member 16 is attached to the upper tubular member 15 via right hand threads 40, the clockwise rotation of the lower tubular member 16 tends to unscrew the lower tubular member 16 from the upper tubular member 15 until they separate as shown in FIG. 3B.

Figure 2:
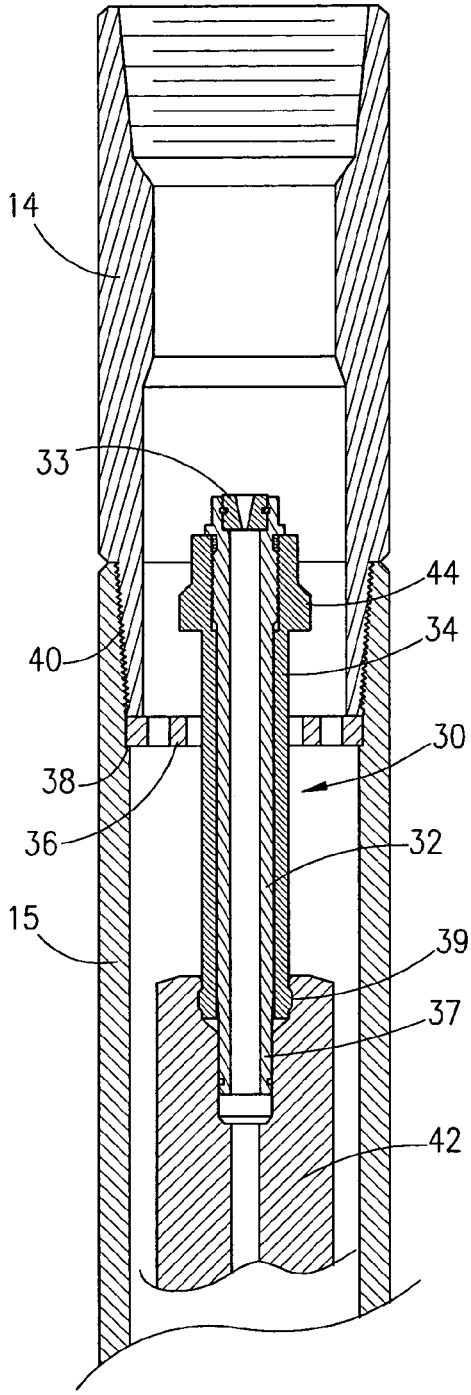
FIG. 2 is a cross-section view of retainer assembly used to capture the drill bit and motor assembly shown in FIG. 1 in the stand-by position.

Referring to FIG. 2, a longitudinal cross-sectional view of a portion of the drill string 10 that includes the joint formed by the coupling of tubular members 14, 15 is shown. It should be noted that the tubular member 14 is a typical sub-section of the tubular drill string 10 and requires no special machining and serves only to house the upper portion of the retainer assembly 30. The retainer assembly 30 includes a tubular central pin member 32, a nozzle member 33, a collet member 34, and a flange member 36 as shown in FIG. 4.

Figure 4:
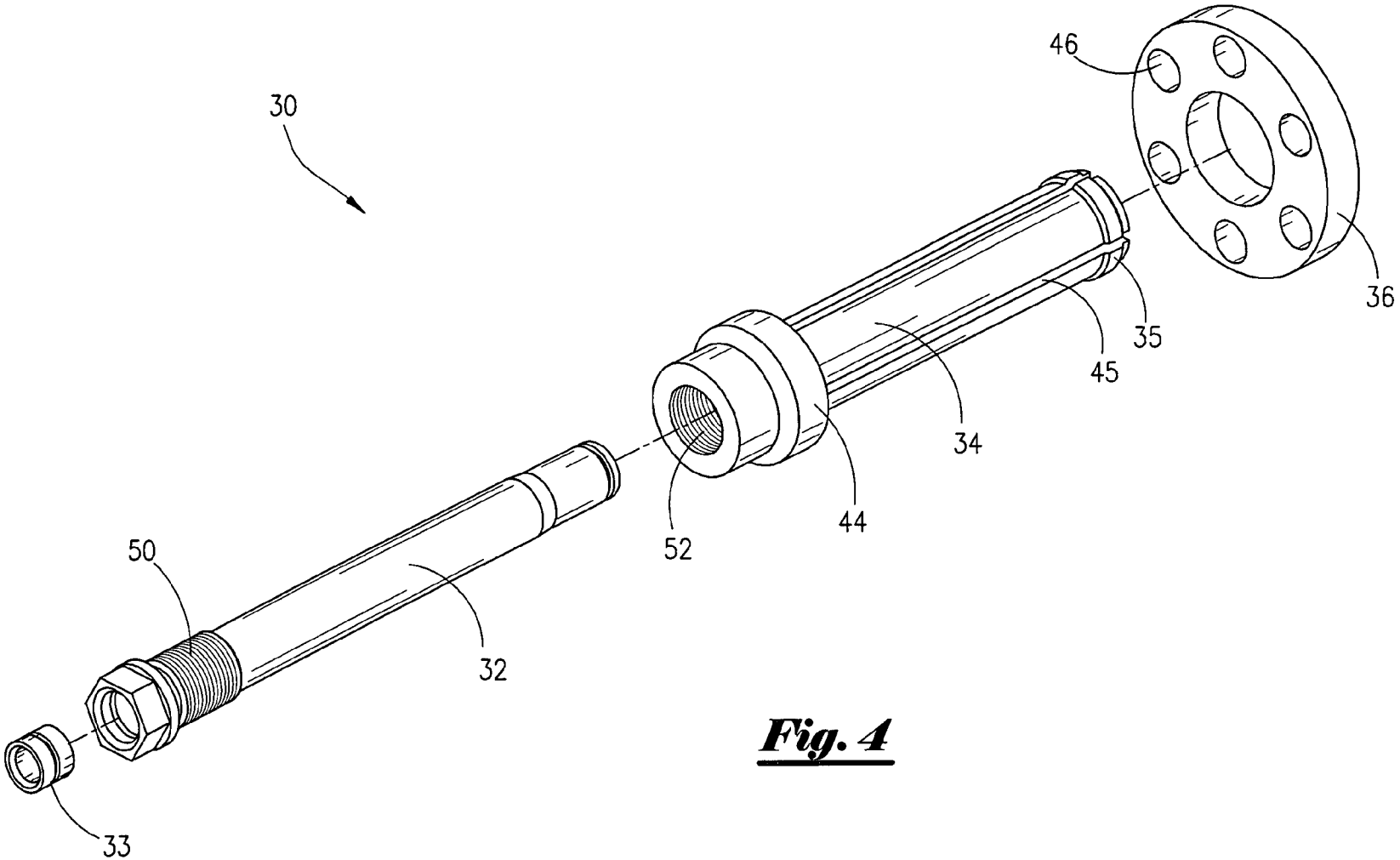
FIG. 4 is an isometric exploded view of the retainer assembly.

As seen in FIG. 4, the collet 34 may be defined as an elongated tubular with a shoulder or collar 44 at one end and an upset 35 at the other. The collet 34 also has a plurality of radially spaced slits 45 extending from the collar 44 to the upset end 35, thereby allowing the collet 34 to be compressed for insertion into the motor rotor 42.

As seen in FIG. 2, a shoulder 38 is formed at the base of the internal threads 40 located at the upper end of the sub-section 15 for seating the flange member 36. The central pin 32 and collet member 34 pass through the flange member 36 and are connected to the motor rotor member 42. Unlike conventional retaining members the instant retainer assembly 30 is not threadably connected to the rotor 42. Instead the end of the motor rotor 42 is counter-bored 37 to accept one end of the pin 32 and the upset portion 35 of the expandable collet 34. Compression of the collet member 34 is required for insertion into the counter-bore 37 in the rotor 42 where the upset portion 35 of the collet member 34 is allowed to expand into a cooperative cavity 39 in the rotor 42, counter bore 37. Insertion of the hollow pin 32 through the center of the collet 34 maintains the upset 35 in the rotor cavity 39. The hollow or tubular pin 32 is threadably retained within the collet 34, as indicated in FIG. 4, by engagement of the external threads 50 on the pin 32 with the internal threads 52 within the collet 34. Rotation and vibration of the rotor 42 is therefore allowed without the possibility of retainer separation.

Figure 3A:
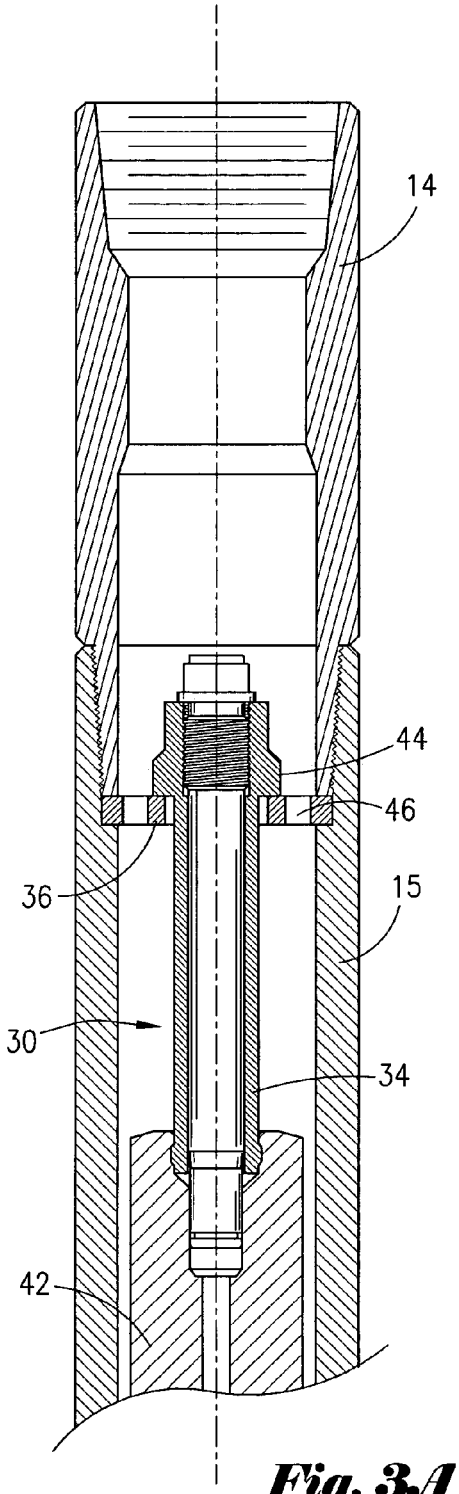
FIG. 3A is a cross-section view of the retainer assembly in the capture position.
Figure 3B:
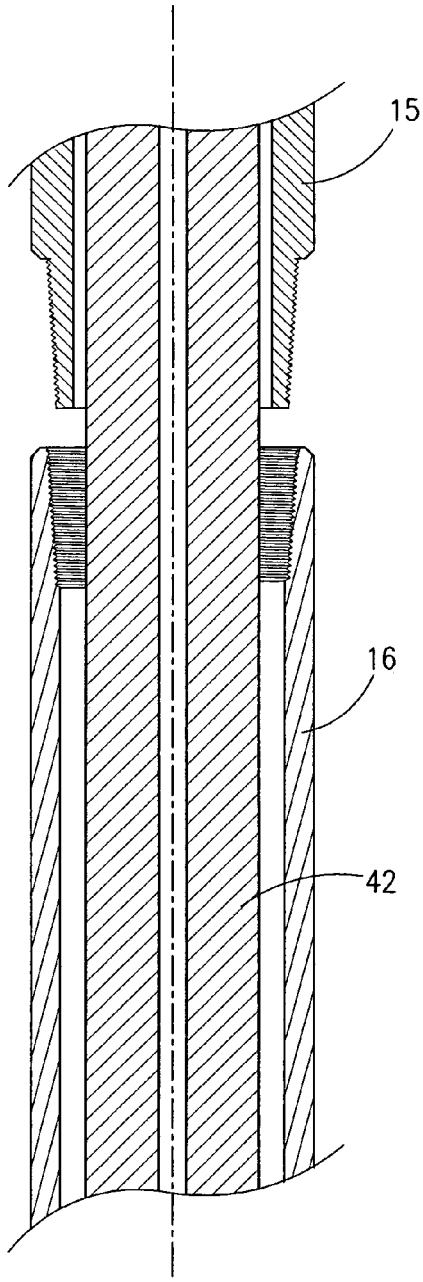
FIG. 3B is a longitudinal continuation of the cross-section view shown in FIG. 3A showing the drive motor stator separation.

As seen in FIG. 3A, if separation of the motor drive sub-section 15 occurs relative to the sub section 16 as seen in FIG. 3B, the collar portion 44 of the collet 34 comes into contact with the flange member 36, thus preventing loss of the drive motor assembly 22 and bit 20.

It has been found that it is not only unnecessary to notify topside personnel of an uncoupling situation down-hole, it may also in fact be detrimental to the pumping operation. Therefore, fluid flowing through the drill string 10 is allowed to flow freely through a plurality of orifices 46 located in the flange member 36 without interruption should an uncoupling situation occur. Since a pressure loss occurs as a result of the decoupling, sufficient warning is given.

It should also be noted that the tool joint located between sub-sections 14 and 15 is not affected by counter rotation and therefore only serves to lock the flange 36 in position relative to the joint.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A retaining apparatus for preventing separation and possible loss of a down-hole fluid motor and bit assembly due to decoupling of threaded drill string sub-sections adjacent to the fluid motor assembly, the apparatus comprising:

a) a flange having a central bore and a plurality of orifices retained within a drill string sub-section located adjacent a fluid motor assembly; and b) an elongated tubular collet having a collar portion at one end and an upset portion adjacent the opposite end attached to an end of a rotor portion of the fluid motor and retained therein by a tubular pin extending longitudinally through the collet, the tubular collet and tubular pin being spaced apart from the central bore of the flange.

2. The apparatus according to claim 1 wherein the end of the rotor portion is counter bored to receive the upset portion of the collet and tubular pin.

3. The apparatus according to claim 1 wherein the tubular pin is threadably retained within the tubular collet.

4. The apparatus according to claim 1 wherein the tubular pin further comprises a removable nozzle at one end.

5. A retaining apparatus for preventing separation and possible loss of a down-hole fluid motor and bit assembly due to decoupling of threaded drill string sub-sections adjacent to the fluid motor assembly, the apparatus comprising:

a) a tubular sub-section having a threaded box end and a threaded pin end defining a housing for a down-hole fluid motor;

b) a rotor assembly rotatable within the tubular sub-section;

c) a removable flange having a central bore and a plurality of orifices located within the threaded box end;

d) a retainer assembly comprising an elongated tubular collet having a collar at one end and an upset at the opposite end and a plurality of longitudinal slits extending through the central bore of the flange;

e) a counter bore and cavity located within one end of the rotor assembly for receiving the collet; and f) an elongated tubular pin extending longitudinally through said collet and into the counter bore for expanding the upset portion of the collet into the cavity.

6. The retaining apparatus according to claim 5 wherein the removable flange is retained within the subsection by threadably coupling the pin end of a second subsection into the threaded box end containing the flange.

7. A retaining apparatus according to claim 5 wherein said collar is larger than the central bore of the flange.

8. A method for retaining a down-hole fluid motor and drill bit assembly in the event of decoupling of the drill string due to counter rotating torque, the method comprising the steps of:

a) installing a removable flange having a central bore and a plurality of orifices therein within a threaded joint of the drill string adjacent the down-hole motor and bit assembly;

b) inserting a collet having a collar at one end larger than the central bore of the flange and an upset portion at the opposite end, through the central bore of the flange;

c) counter-boring the end of the fluid motor's rotor to receive the upset portion of the collet;

d) inserting the upset portion of the collet into the counter-bored end of the rotor;

e) securing the collet within the rotor by inserting an elongated tubular pin longitudinally through the collet, thereby preventing retraction of the upset portion of the collet from the rotor; and f) securing the tubular pin within the collet.

9. The method according to claim 8 further comprising the step of retaining the down-hole fluid motor and drill bit assembly in close contact with the drill string in the event of a decoupling of the fluid motor and bit assembly from the drill string.

10. The method according to claim 8 further comprising the step of inserting a nozzle within the tubular pin.

* * * * *